US005833053A

United States Patent [19]

Wood et al.

[11] Patent Number: 5,833,053

[45] Date of Patent: Nov. 10, 1998

[54] INFLATABLE EYEGLASS CASE

[76] Inventors: James Wood, 1012 Johnson St., Hollywood, Fla. 33019; Werner Stemer, 1008 SW 5th Pl., Fort Lauderdale, Fla. 33312

[21] Appl. No.: 834,529

[22] Filed: Apr. 4, 1997

[51] Int. Cl.[6] ..... A45C 11/04

[52] U.S. Cl. ..... 206/5; 206/522; 206/6

[58] Field of Search ..... 206/5, 6, 522; 383/3

[56] References Cited

U.S. PATENT DOCUMENTS

| | | | |
|---|---|---|---|
| 1,827,322 | 10/1931 | Lindermann | 206/522 |
| 2,118,165 | 5/1938 | Christopher et al. | 206/522 |
| 2,729,259 | 1/1956 | Abrams | 206/522 |
| 3,038,593 | 6/1962 | Root et al. | 206/522 |
| 4,155,453 | 5/1979 | Ono | 206/522 |
| 4,404,689 | 9/1983 | DeWan . | |
| 4,465,188 | 8/1984 | Soroka et al. | 206/522 |
| 4,551,379 | 11/1985 | Kerr | 206/522 |
| 4,573,202 | 2/1986 | Lee | 383/3 |
| 4,877,334 | 10/1989 | Cope | 206/522 |
| 5,129,509 | 7/1992 | Romolt . | |
| 5,423,419 | 6/1995 | Wentz et al. . | |
| 5,443,671 | 8/1995 | Stechler . | |
| 5,501,321 | 3/1996 | Liu . | |
| 5,513,744 | 5/1996 | Yagarra . | |
| 5,590,760 | 1/1997 | Astarb . | |

FOREIGN PATENT DOCUMENTS

| | | | |
|---|---|---|---|
| 1269738 | 7/1961 | France | 206/522 |
| 2266474 | 10/1975 | France | 206/522 |
| 2320243 | 3/1977 | France | 206/522 |

*Primary Examiner*—David T. Fidei
*Attorney, Agent, or Firm*—Werner H. Stemer

[57] ABSTRACT

An eyeglass case for protectively housing eyeglasses. At least one wall of the case is formed with an inflatable chamber. The chamber may be selectively inflated. The eyeglass case, in its inflated state, protects the eyeglasses to a maximum degree and the case floats. The case may be inflated by blowing into a simple blowhole opening, with an integrated pneumatic pump, or with a gas cartridge that allows repeated inflation. The case may be formed with a soft inner pouch which is surrounded with an inflatable outer pouch, or it may be formed with a rigid bottom shell and a soft, inflatable top in the form of a lid.

20 Claims, 2 Drawing Sheets

INFLATABLE EYEGLASS CASE

BACKGROUND OF THE INVENTION

1. Field of the Invention

The invention pertains to eyeglass cases, also referred to as spectacle cases, and more particularly to an eyeglass case which protects eyeglasses and the like against exterior influences which would scratch the spectacle glasses, bend the spectacle frame, or otherwise damage the eyeglasses.

2. Description of the Related Art

Many different types of eyeglass cases are known in the prior art. These range from soft visor protectors and soft pouches to hard cases. The pouch-type eyeglass case is usually an elongated bag of a soft fabric with an opening on one side. The opening may be provided with a closure, such as with tie straps, with a spring-leaf snap lip, with a flap that may be closed with hook-and-loop type closures (e.g. VELCRO), or with a zipper lock. Hard eyeglass cases are usually formed with a hard plastic core which is lined with soft fabric and which may be covered on the outside with leather or imitation leather or the like. Hard cases may also be formed from pressed sheet metal which is appropriately finished with covers and liners.

The choice of eyeglass case between the soft and the hard case is essentially a trade-off between a minimum of bulk accompanied with a minimum of protection against a maximum of bulk accompanied with a maximum of protection. In other words, the soft pouch provides a certain amount of protection to the spectacle glasses, but not to the frames. However, when the glasses are not in the pouch, the same can be unobtrusively stashed away, rolled up, or the like. The hard case provides superior protection to the glasses and to the frame. However, the case is equally bulky regardless of whether the eyeglasses are or are not in the case. Such hard cases are often a nuisance, in particular when they are used with sunglasses in a leisure context.

For obvious reasons, the art has also known waterproof, floatable eyeglass cases. A recent such case is described in U.S. Pat. No. 5,423,419 to Wentz. There is provided a molded plastic case formed with two hollow shell parts. When the case is closed, it is watertight. The air volume which is enclosed provides a sufficient amount of buoyancy to keep the eyeglass case afloat in water. The case is a hard plastic case similar to a canister. While a maximum amount of protection is afforded by the case, it is also very bulky.

A semi-soft protective case is described in U.S. Pat. No. 5,129,509 to Romolt. There, a porous inner web is composite bonded with an impermeable outer web, and a U-shaped clip is mounted on an adhesive forward face of the case, so that the case may be clipped onto a belt or the like. Several dispenser tubes are integrated into the liner which hold anhydrous fluid, which is slowly dispensed into the liner. The lenses or the spectacles, when they are inserted into the case, are thereby exposed to a substantially dry environment because the anhydrous fluid absorbs any residual moisture.

In choosing from any of the foregoing types of prior art eyeglass cases, the user must always sacrifice one property or advantage for another as described, in that several of the afore-described features are essentially exclusive of each other. If the user, for example, opts for the hard case, and possibly even for a floatable hard case, he must then carry the bulky hard case with him even when the glasses are in use. On the other hand, if the user opts for the soft case which is easily stored away, he sacrifices a considerable degree of protection and, in addition, the soft case will not float.

SUMMARY OF THE INVENTION

It is accordingly an object of the invention to provide an eyeglass case, which overcomes the above-mentioned disadvantages of the prior art devices and methods of this general type and which allows an easy and quick conversion of the eyeglass case between the genus of hard, bulky cases to the genus of soft, easily stowed away cases. In addition, the eyeglass case should be floatable so as to be properly suited for marine and other leisure activities.

With the foregoing and other objects in view there is provided, in accordance with the invention, an eyeglass case, comprising:

a body defining a cavity for receiving and housing eyeglasses therein;

the body being formed with at least one wall having an inflatable chamber formed therein; and and an opening communicating with the inflatable chamber for selectively inflating the at least one wall.

In accordance with an added feature of the invention, the body is formed with an inner pouch of soft material, and the at least one wall with the inflatable chamber is a collapsible outer pouch enclosing the inner pouch, the outer pouch being airtightly sealed towards an exterior and towards the inner pouch, except for the opening which allows inflation of the outer pouch.

In accordance with an additional feature of the invention, there is provided an air source communicating with the opening, such as a pneumatic pump.

In accordance with a concomitant feature of the invention, the body is formed as a rigid bottom shell and an inflatable top pivotally attached to the bottom shell. The inflatable chamber and the opening are formed in the top, and the top further includes a pneumatic pump for manually inflating the top.

Other features which are considered as characteristic for the invention are set forth in the appended claims.

Although the invention is illustrated and described herein as embodied in an inflatable eyeglass case, it is nevertheless not intended to be limited to the details shown, since various modifications and structural changes may be made therein without departing from the spirit of the invention and within the scope and range of equivalents of the claims. Specifically, the protective case may be utilized in various contexts, such as for inflatable plates and dishware for campers, inflatable protectors for valuables, inflatable helmet liners for toddlers, etc.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
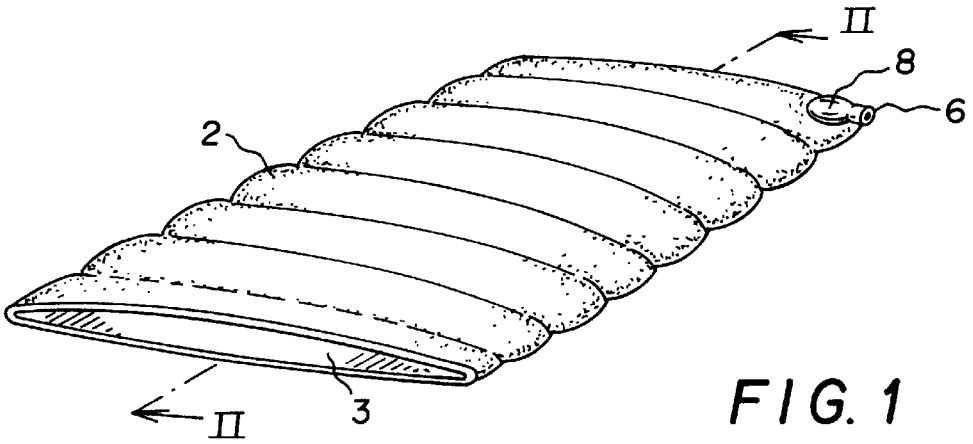
FIG. 1 is a front, top perspective view of a soft eyeglass case according to the invention.
Figure 2:
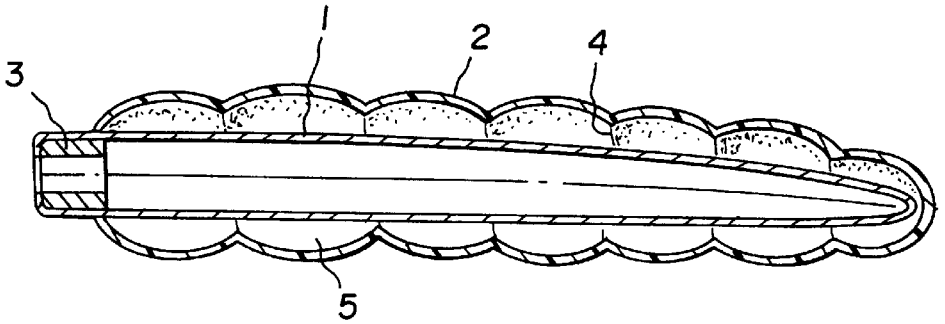
FIG. 2 is a sectional view of the eyeglass case taken along the line II—II in FIG. 1, and in a more-inflated condition than that shown in FIG. 1.

Referring now to the figures of the drawing in detail and first, particularly, to FIGS. 1 and 2 thereof, an inner pouch 1 is made of a soft material, such as natural or artificial fiber fabric, polyplastic material, fiber-reinforced polyethylene or polyurethane, and the like. The inner pouch 1 is enclosed by a collapsible outer pouch 2. The outer pouch is hermetically airtightly sealed towards the exterior and towards the inner pouch 1. The eyeglass case according to the embodiment of FIGS. 1 and 2 is held shut by a double leaf spring 3 which forms a lip. Such closures are known from the prior art. The outer pouch 2 is attached to the inner pouch 1 via several webs 4. The webs 4, which ensure that the outer pouch 2, upon being inflated, does not assume any arbitrary shape, do not airtightly seal several chambers 5 of the outer pouch 2. Instead, a single air source 6 is used to inflate the entire structure.

The air source 6, in its simplest form, is a blowhole with an automatically closing membrane which allows oral inflation of the eyeglass case. Such assemblies are well known from air mattresses and inflatable toys. In a slightly more complicated form—which is indeed the inventors' preferred embodiment—the air source 6 is a small, integrated air pump 7.

Figure 3:
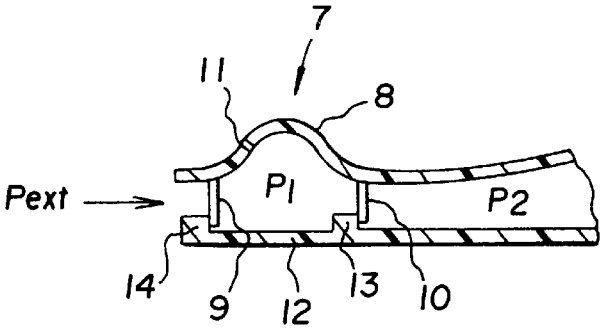
FIG. 3 is a schematic view of a pneumatic pump.

With reference to FIG. 3, the air pump 7 operates according to the bellows pump principle: In the equilibrium position illustrated in FIG. 3, a pressure $p_1$ inside the pump 7 equals an ambient pressure $p_{ext}$ and a pressure $p_2$ inside the pouch 2. When the pump bulb 8 is depressed (e.g. by depressing the bulb with the user's thumb), the volume inside the bulb decreases, thus raising the pressure $p_1$. The pressure differential $\Delta p=p_1-p_2$ now forces a membrane 10 to open and the excess air volume from the pump escapes into the pouch 2. When the manual pressure on the bulb 8 is released, it returns to its original position. For that purpose, the bulb 8 may be reinforced with a plate spring 11 or the like. As the bulb 8 returns to its original position, the volume within the pump chamber increases, thus lowering the pressure $p_1$. The pressure differential $\Delta p=p_1-p_2$ now points in the opposite direction and immediately closes the membrane 10. Instead, the membrane 9 is opened and ambient air enters into the pump chamber, until approximate pressure equilibrium $p_{ext}=p_1$ is attained. The bulb 8 is then repeatedly depressed until the desired pressure $p_2$ has been attained within the pouch 2.

The pouch 2 may be deflated in various ways. For instance, an additional port may be provided with a removable plug. Preferably, however, the pump 7 is constructed such that it may be opened by squeezing the pump laterally. In other words, pressure applied from the side (into and out of the drawing plane in FIG. 3) causes the lower wall 12 of the pump 7 to retract downwardly. Stop ledges 13 and 14 thereby release the membranes 9 and 10 so that they can swing to the left and any pressure differential between the pressures $p_2$, $p_1$ and $p_{ext}$ is reduced to equilibrium. In that regard, it may be necessary to squeeze or roll the pouch similarly to emptying an air mattress, in order to force the air out of the pouch 2.

In an alternative embodiment, the air source 6 may be an integrated gas cartridge (e.g. an $O_2$ source) which contains a certain number of filling charges for inflating the pouch 2, such as, say, between 50 and 100 charges.

Figure 4:
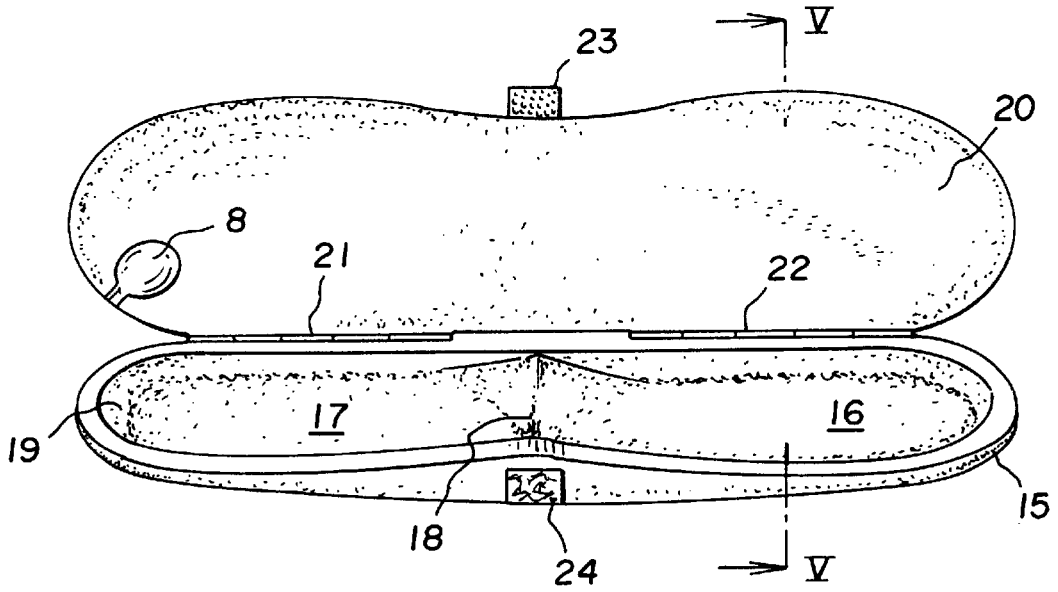
FIG. 4 is a front, top perspective view of a second embodiment of the eyeglass case according to the invention.
Figure 5:
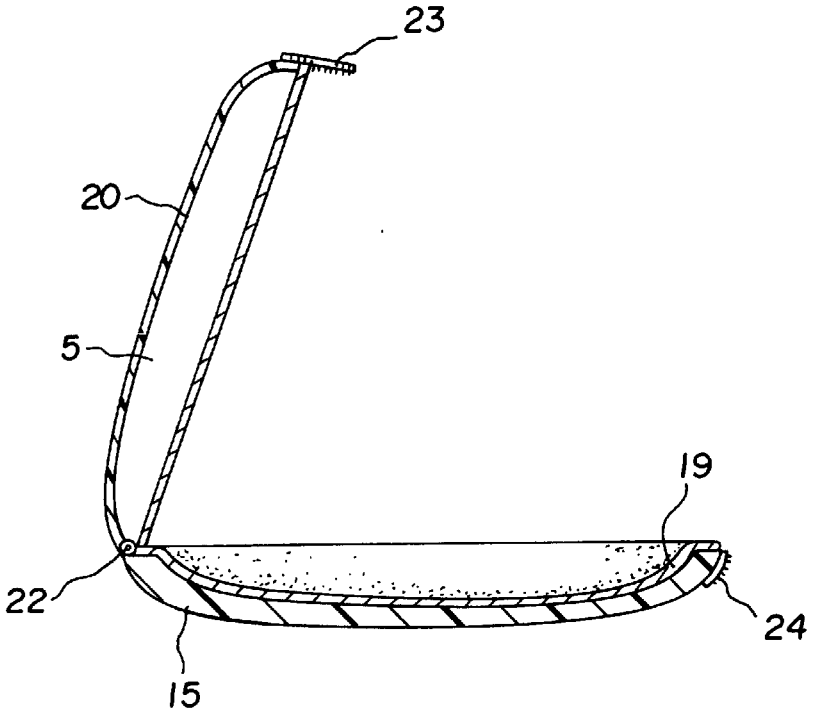
FIG. 5 is a sectional view of the eyeglass case taken along the line V—V in FIG. 4.

With reference to FIGS. 4 and 5, which illustrate a further embodiment of the invention, a rigid bottom shell 15 is formed with two troughs 16, 17 for receiving the lenses of the eyeglasses and with a bridge-trough 18 for the nose bridge. In other words, the bottom shell 15 would receive the glasses with their lenses down and the bridge forward towards the viewer of the figure. A soft cloth liner 19 is glued into the bottom shell 15.

An inflatable semi-soft top 20 is pivotally attached to the bottom shell 15 at two hinges 21, 22. A closure flap 23 may be engaged at a corresponding closure pad 24, attached to the bottom shell 15. In the preferred embodiment, the closure 23, 24 is formed with hook-and-loop fasteners. Other fasteners, such as for instance snaps or the like, are equally possible. The top 20 is inflatable by means of the air pump 8. When the top 20 is deflated, the thickness (i.e., the bulkiness) of the eyeglass case, and also the degree of protection afforded thereby, is defined by the rigid bottom shell 15. With the top 20 inflated, a maximum degree of protection is effected. In addition, the eyeglass case is then also able to float with the spectacles inside.

We claim:

1. An eyeglass case, comprising:

a body defining a cavity for receiving and housing eyeglasses therein;

said body having a rigid bottom shell with a soft liner for supporting the eyeglasses thereon, and an inflatable top pivotally attached to said rigid bottom shell;

said inflatable top having an inflatable chamber formed therein; and an opening communicating with said inflatable chamber for selectively inflating said inflatable top.

2. The eyeglass case according to claim 1, which further comprises an air source communicating with said opening.

3. The eyeglass case according to claim 2, wherein said air source is a pneumatic pump.

4. The eyeglass case according to claim 2, wherein said air source is a gas cartridge.

5. The eyeglass case according to claim 1, which further comprises an external port communicating with said opening for allowing oral inflation of said chamber.

6. The eyeglass case according to claim 1, which further comprises a pneumatic pump integrated in said top for manually inflating said top.

7. The eyeglass case according to claim 1, which further comprises a blowhole port communicating with said opening for orally inflating said top.

8. The eyeglass case according to claim 1, which further comprises a gas cartridge integrated in said top for inflating said top.

9. An eyeglass case, comprising:

a body formed with walls defining a cavity for receiving and housing eyeglasses therein, said body having an insertion opening through which eyeglasses are selectively insertible into and removable from said cavity;

a double leaf spring attached at and holding said insertion opening shut in a position of repose;

at least one of said walls having an inflatable chamber formed therein; and an opening communicating with said inflatable chamber for selectively inflating said at least one of said walls.

10. The eyeglass case according to claim 9, wherein said body includes an inner pouch of soft material, and said at least one wall with said inflatable chamber being a collapsible outer pouch enclosing said inner pouch, said outer pouch being airtightly sealed towards an exterior and towards said inner pouch.

11. The eyeglass case according to claim 9, which further comprises an air source communicating with said opening.

12. The eyeglass case according to claim 11, wherein said air source is a pneumatic pump.

13. The eyeglass case according to claim 11, wherein said air source is a gas cartridge.

14. The eyeglass case according to claim 9, which further comprises an external port communicating with said opening for allowing oral inflation of said chamber.

15. The eyeglass case according to claim 9, which further comprises a pneumatic pump integrated in said body for manually inflating said chamber.

16. The eyeglass case according to claim 15, wherein said pneumatic pump includes a bulb defining a collapsible chamber and a first membrane closing said collapsible chamber towards an external port opening and a second membrane closing said collapsible chamber towards said inflatable chamber, said pneumatic pump being adapted to selectively allow oral inflation of said inflatable chamber or manual inflation by repeated manual collapsing of said bulb.

17. The eyeglass case according to claim 9, which further comprises a blowhole port communicating with said opening for orally inflating said chamber.

18. The eyeglass case according to claim 9, which further comprises a gas cartridge integrated in said body for inflating said chamber.

19. The eyeglass case according to claim 3, wherein said pneumatic pump includes a bulb defining a collapsible chamber and a first membrane closing said collapsible chamber towards an external port opening and a second membrane closing said collapsible chamber towards said inflatable chamber, said pneumatic pump being adapted to selectively allow oral inflation of said inflatable chamber and manual inflation by repeated manual collapsing of said bulb.

20. The eyeglass case according to claim 1, wherein said rigid bottom shell with said soft liner for supporting the eyeglasses thereon is formed with two troughs for receiving respective lenses of the eyeglasses and a bridge trough for receiving a nose bridge between the lenses.

* * * * *